US009008834B2

(12) United States Patent
Forster

(10) Patent No.: US 9,008,834 B2
(45) Date of Patent: Apr. 14, 2015

(54) CONTROL DEVICE AND METHOD FOR CONTROLLING THE SPEED OF A CONVEYOR

(75) Inventor: Stefan Forster, Ruti (CH)

(73) Assignee: Ferag AG, Hinwil (CH)

( * ) Notice: Subject to any disclaimer, the term of this patent is extended or adjusted under 35 U.S.C. 154(b) by 61 days.

(21) Appl. No.: 13/583,599

(22) PCT Filed: Feb. 22, 2011

(86) PCT No.: PCT/CH2011/000031

§ 371 (c)(1),
(2), (4) Date: Nov. 13, 2012

(87) PCT Pub. No.: WO2011/109916

PCT Pub. Date: Sep. 15, 2011

(65) Prior Publication Data

US 2013/0060376 A1 Mar. 7, 2013

(30) Foreign Application Priority Data

Mar. 11, 2010 (CH) ..... 0340/10

(51) Int. Cl.

| | |
|---|---|
| ***G06F 7/00*** | (2006.01) |
| ***B65H 5/34*** | (2006.01) |
| ***B65H 5/08*** | (2006.01) |
| ***B65H 5/26*** | (2006.01) |
| ***B65H 29/04*** | (2006.01) |
| ***B65H 29/28*** | (2006.01) |
| ***B65H 29/60*** | (2006.01) |
| ***B65H 31/24*** | (2006.01) |

(52) U.S. Cl.

CPC ..... *B65H 5/34* (2013.01); *B65H 5/085* (2013.01); *B65H 5/26* (2013.01); *B65H 29/042* (2013.01); *B65H 29/28* (2013.01); *B65H 29/60* (2013.01); *B65H 31/24* (2013.01); *B65H 2301/323* (2013.01); *B65H 2301/4433* (2013.01); *B65H 2301/44712* (2013.01); *B65H 2513/10* (2013.01)

(58) Field of Classification Search

USPC ..... 700/230

See application file for complete search history.

(56) References Cited

U.S. PATENT DOCUMENTS

| | | | | |
|---|---|---|---|---|
| 3,531,108 | A * | 9/1970 | Gingras et al. | 271/305 |
| 7,963,386 | B2 * | 6/2011 | Stauber | 198/442 |
| 2005/0139454 | A1 * | 6/2005 | Ohno et al. | 198/644 |
| 2008/0067740 | A1 | 3/2008 | Keane et al. | |
| 2010/0030373 | A1 * | 2/2010 | Lee et al. | 700/223 |

FOREIGN PATENT DOCUMENTS

| | | | |
|---|---|---|---|
| EP | 0 358 065 | A2 | 3/1990 |
| EP | 1 072 548 | A2 | 1/2001 |
| EP | 1 547 951 | A1 | 6/2005 |
| EP | 1 935 821 | A1 | 6/2008 |
| GB | 2 140 785 | A | 12/1984 |
| WO | WO 2009/015503 | A1 | 2/2009 |

* cited by examiner

*Primary Examiner* — Gene Crawford
*Assistant Examiner* — Kyle Logan
(74) *Attorney, Agent, or Firm* — Knobbe, Martens, Olson & Bear, LLP

(57) ABSTRACT

An object of the present invention is to propose a computerized control device and a computer-implemented method for speed regulation during delivery of printed products to stacking devices which do not have at least some of the disadvantages of the known systems. It is in particular an object of the present invention to propose a computerized control device and a computer-implemented method for regulating the speed of a conveyor for delivering printed products to stacking devices which enable flexible production of stacks of different sizes.

15 Claims, 6 Drawing Sheets

CONTROL DEVICE AND METHOD FOR CONTROLLING THE SPEED OF A CONVEYOR

This application is the U.S. National Phase under 35 U.S.C. §371 of International Application No. PCT/CH2011/000031, filed Feb. 22, 2011, which claims priority to Swiss Application No. 00340/10, filed Mar. 11, 2010.

TECHNICAL FIELD

The present invention relates to a computerized control device and a computer-implemented method for regulating the speed of a conveyor in a printed product processing facility. The present invention relates in particular to a computerized control device and a computer-implemented method for regulating the speed of a conveyor for delivering printed products to stacking devices which form stacks from supplied printed products.

PRIOR ART

In printed product processing facilities, products are formed in collecting facilities from a plurality of intermediate and primary products by collation, insertion or collection (in the narrower sense), with these products being supplied by a conveyor to one or more stacking devices which stack the products to form stacks. In the known printed product processing facilities, the speed of the conveyor is matched fixedly to the processing speed or the processing power of the stacking stations used. In the event of failure of a stacking device, the conveying speed needs to be reduced to a defined value corresponding to the remaining available stacking stations. In this case, it is often necessary to stop the printed product processing facility and/or to resume operation at a manually set, reduced conveying speed. In order to prevent overload of the stacking devices and reduce failures as far as possible, the conveying speed is limited fixedly to a value which is below the maximum possible processing power of the stacking devices, in particular when the stacking devices are intended to produce stacks with different and sometimes varying sizes.

The laid-open specification EP 1 935 821 describes a method for stacking printed products in a production line, in which the process for collating the printed sheets to form intermediate products is controlled depending on the stack size to be formed. According to EP 1 935 821, a minimum number of cycles which are required by the stacking devices for forming a stack is calculated on the basis of the cycle time for the delivery of a stack and the cycle number at which the production line produces. If particularly small stacks need to be formed with a relatively low number of cycles, empty cycles are introduced in the production line according to EP 1 935 821, which reduces the production capacity of the production line.

DESCRIPTION OF THE INVENTION

An object of the present invention is to propose a computerized control device and a computer-implemented method for speed regulation during delivery of printed products to stacking devices which do not have at least some of the disadvantages of the known systems. It is in particular an object of the present invention to propose a computerized control device and a computer-implemented method for regulating the speed of a conveyor for delivering printed products to stacking devices which enable flexible production of stacks of different sizes.

In accordance with the present invention, these aims are achieved in particular by the elements of the independent claims. Further advantageous embodiments emerge also from the dependent claims and the description.

The abovementioned aims are achieved by the present invention in particular in that, in order to regulate the speed of a conveyor for delivering printed products to stacking devices which form stacks from products supplied, an assignment plan is run for the stacking devices with products which were detected at a detection point upstream of the stacking devices on the conveyor and are processable by in each case one associated stacking device at a defined setpoint speed of the conveyor. The setpoint speed of the conveyor is automatically reduced when it is not possible to determine, in the assignment plan for at least one product, a stacking device which can process the at least one product at the unreduced setpoint speed of the conveyor, i.e. when the product in question in the assignment plan cannot be associated to one of the stacking devices in such a way that it is processable at the unreduced setpoint speed of the conveyor. In this case, it is determined, for a product, preferably on the basis of the present position of the product in question, on the basis of the processing speeds of the stacking devices, on the basis of the setpoint speed of the conveyor, and on the basis of the association of products to in each case one of the stacking devices according to the assignment plan, whether and by means of which of the stacking devices the product in question is processable at the defined setpoint speed of the conveyor. In this case, the present position of a product on the conveyor defines in each case its relative position or distance with respect to the inputs of the stacking devices.

Preferably, in each case one present position on the conveyor or in the associated stacking devices is determined for the products included in the assignment plan, and the setpoint speed of the conveyor is increased when a product which has been the cause of a reduction in the setpoint speed of the conveyor has reached a defined position (in the printed product processing facility). The setpoint speed of the conveyor is increased, for example, when the product which has been the cause of a reduction in the setpoint speed of the conveyor has reached the release point for transfer to the associated stacking device or has already been triggered at this point and has been transferred to the stacking device or has been processed prior to the stacking device.

The determination as to whether and by means of which of the stacking devices the products transported on the conveyor are processable at the defined setpoint speed of the conveyor and the virtual assignment of the products to the individual stacking devices based thereon enable automatic, dynamic and flexible matching of the conveying speed to product-specific parameters and states, such as product thickness, stack size, number of products in stack, stack structure and availability and processing speed of stacking devices, wherein an overflow of non-processable products is avoided as far as possible and the production capacity (i.e. products/time) is kept as high as possible. In particular in the case of a plurality of stacking devices, this dynamic matching of the conveying speed enables a high degree of flexibility in the stack formation with individually different and temporally varying stack sizes in the individual stacking devices.

In a preferred variant embodiment, the present conveying speed of the conveyor is set to the setpoint speed in each case at a defined point in time and, in the assignment plan, a product is associated to one of the stacking devices when the product in question is processable by the stacking device in question at a conveying speed which is set to the reduced setpoint speed from the defined point in time on.

In one variant embodiment, the time for setting the present conveying speed of the conveyor to the reduced setpoint speed is set to be as late as possible such that the product in question is still processable by the associated stacking device in question. Prolonging a reduction in speed as long as possible has the advantage that the conveying speed and therefore the operating performance are kept as high as possible, while the processability of the product is maintained and a product overflow is avoided.

In one variant embodiment, the present conveying speed of the conveyor is set to the setpoint speed at periodic points in time. The period of the points in time for the gradual matching of the conveying speed to a reduced or increased setpoint speed is preferably a multiple of the time period in which two successive products on the conveyor pass a fixed reference point, for example the detection point. At a conveying speed of 36 000 products/h, the period between two products is 0.1 second, for example, and the gradual matching of the conveying speed is performed, for example, in each case after ten products in a single-second cycle. The limitation of the matching of the conveying speed to points in time which follow one another in identical time segments has the advantage that an excessively frequent change in the conveying speed and an inclination of the system to oscillate, which is associated therewith, are avoided. In a combined variant, the above-described point in time which is as late as possible is fixed to the directly preceding "periodic point in time".

In a further preferred embodiment, in the event of a reduction in the setpoint speed of the conveyor, the products which are included in the assignment plan and are still located on the conveyor are each associated afresh to one of the stacking devices which can process the product in question at the reduced setpoint speed of the conveyor. The fresh assignment of the products which have not yet been triggered and which are not located in the overflow region in the event of any reduction in speed enables continuous automatic optimization of the production planning and implementation by processable assignment of the products to the stacking devices in a manner matched dynamically to the conveying speed.

In addition to a computerized control device and a computer-implemented method for regulating the speed of a conveyor for delivering printed products to stacking devices, the present invention moreover relates to a computer program product which comprises a computer-readable storage medium with a stored computer code. The computer code is configured to control one or more processors of the control device in such a way that the processors or the control device run an assignment plan for the stacking devices with products which were detected at a detection point upstream of the stacking devices on the conveyor and are processable by in each case one associated stacking device at a defined setpoint speed of the conveyor, and that the processors or the control device reduce the setpoint speed of the conveyor when at least one product in the assignment plan cannot be associated to one of the stacking devices in such a way that it is processable at the unreduced setpoint speed of the conveyor.

BRIEF DESCRIPTION OF THE DRAWINGS

An embodiment of the present invention will be described below with reference to an example. The example of the embodiment is illustrated by the following figures attached.

APPROACHES FOR IMPLEMENTING THE INVENTION

Figure 1:
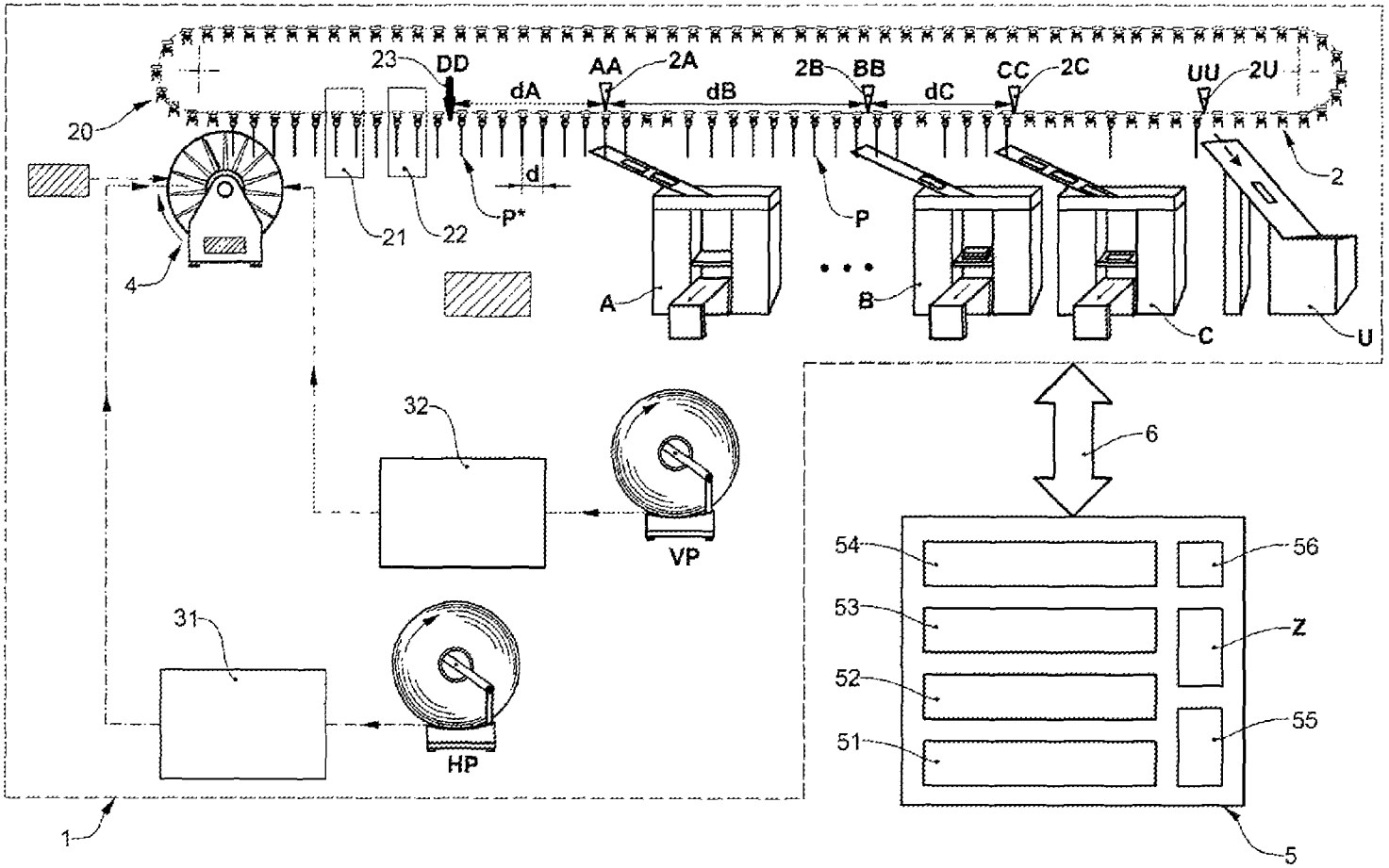
FIG. 1 shows a block diagram of a schematically illustrated computer-controlled printed product processing facility which comprises a plurality of stacking devices, an overflow station and a conveyor for delivering printed products.
Figure 2:
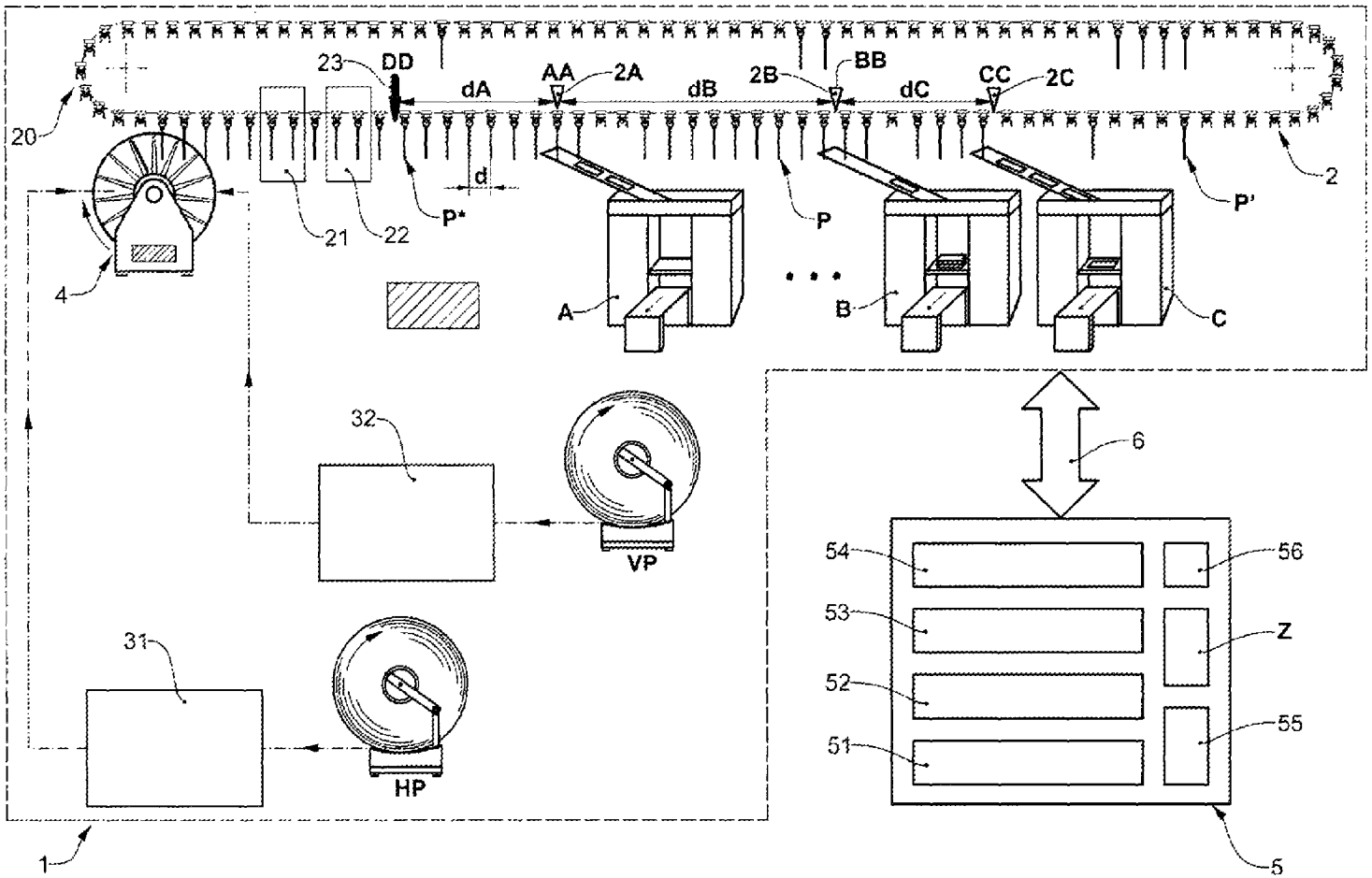
FIG. 2 shows a block diagram which illustrates schematically the printed product processing facility shown in FIG. 1 without the overflow station.

In FIGS. 1 and 2, the reference symbol 1 relates to a computer-controlled printed product processing facility with at least one conveyor 2 and a plurality of stacking devices A, B, C. The conveyor 2 is, for example, in the form of a chain conveyor with product carriers 20, in particular grippers, for example clamps, for gripping and holding printed products P or other flat products, such as data carriers, for example.

The printed product processing facility 1 and in particular the conveyor 2 operate in a so-called off-line mode, in the sense that they are not coupled directly to machines for producing printed products, but receive the printed products from a product store.

In the configuration shown in FIGS. 1 and 2, the products P are supplied by a collecting facility 4 with a constant speed or supply rate to the conveyor 2, where they are seized in each case by one of the product carriers 20 and conveyed away on the conveyor 2. The collecting facility 4 assembles the products P, for example in each case consisting of one or more separated intermediate products VP and a primary product HP which are supplied by separating devices 31, 32. The collecting facility 4 is, for example, in the form of a collating device for collating, in the form of an insertion drum for insertion or in the form of a collecting device for collecting (in the narrower sense) the intermediate products VP and the primary product HP to form a resultant product P (end product). As illustrated in FIGS. 1 and 2, the intermediate products VP and primary products HP are supplied to the separating devices 31, 32, for example on a coil in the form of rolled-up imbricated streams.

In one variant embodiment, one or more product processing devices, for example a stretch wrapping machine for packing the products P in a packaging wrap, are arranged between the collecting facility 4 and the conveyor 2. Further product processing devices 21, 22 are also arranged in the case of the conveyor 2, depending on the variant embodiment, for example a stapler for stapling the product during transport with a product carrier 20, or an addressing device for printing or sticking an address of a recipient, an information sheet, a trade sample or another add on to the products P held in a product carrier 20.

As can be seen from FIGS. 1 and 2, a product detector 23, for example a counting finger or optical sensor, which is configured to detect and sense in data-technical fashion a product P conveyed passed a detection point DD in a product carrier 20 is arranged on the conveyor 2. In addition to the presence of the product P in the product carrier 20 in question, the product detector 23 preferably senses the type or the composition of the product P in question. In the context of superordinate production control and route planning, the product P is individually determinable and identifiable and its present position in the printed product processing facility 1 is continuously defined. In a route, in each case the association of geographically distributed unloading areas (addresses) and stacks to be unloaded is fixed in each case.

The reference symbols 2A, 2B, 2C in FIGS. 1 and 2 and the reference symbol 2U in FIG. 1 relate in each case to a release device, which is configured to release a product P held in a product carrier 20 at the release point AA, BB, CC or UU in question and transfer it to the stacking device A, B, C or overflow station U in question.

Figure 3:
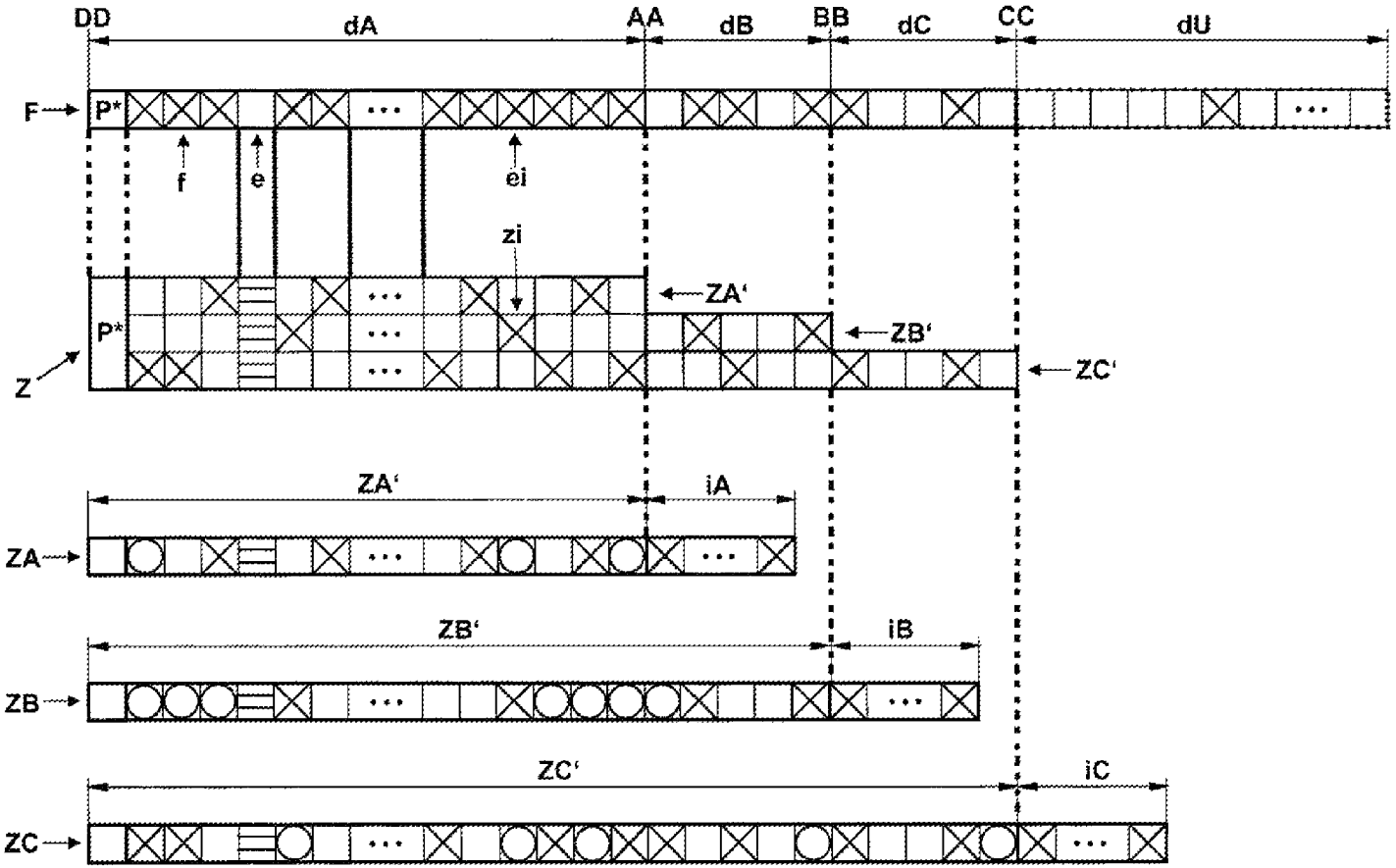
FIG. 3 shows an overflow illustrating an example of an assignment of products on the conveyor to stacking devices.

In FIGS. 1, 2 and 3, the reference symbols dA, dB, dC each denote a section on the conveyor 2 between the detection point DD and the release point AA, between the release points AA and BB or between the release points BB and CC. The sections dA, dB, dC are each defined by their length and/or their number of product carriers 20 which are arranged on the conveyor 2 in each case at a constant distance d from one another.

As is illustrated in FIGS. 1 and 2, the printed product processing facility 1 is connected to a computerized control device 5 via a communications link 6. The communications link 6 comprises, for example, one or more parallel and/or serial data buses and/or a local area network.

The control device 5 comprises one or more operational computers each having one or more processors. The control device 5 is preferably connected to the various components of the printed product processing facility 1, in particular to the conveyor 2, the product detector 23, the release devices 2A, 2B, 2C, 2U, the stacking devices A, B, C, the overflow station U, the product processing devices 21, 22, the collecting facility 4, the separating devices 31, 32 and to various sensors, actuators and counters of these components, via the communications link 6 for data interchange.

As is illustrated schematically in FIGS. 1 and 2, the control device 5 comprises various function modules, in particular a tracking module 51, a regulation module 52, a planning module 53 and a control module 54 as well as data stores or program memories for storing the setpoint speed 55 (setpoint speed value), a route plan 56 and an assignment plan Z. The function modules are preferably in the form of programmed software modules which comprise computer program code for controlling one or more processes of the computer of the control device 5. The computer program code is stored on one or more (tangible) computer-readable storage media connected fixedly or removably to the processors. A person skilled in the art will understand, however, that the function modules can be embodied in alternative variant embodiments partially or completely by hardware components.

The control module 54 is configured to control the printed product processing facility 1 on the basis of the route plan 56 in such a way that stacks for delivery which comprise a plurality of products P consisting of a primary product HP and one or more intermediate products VP and are produced and arranged in such a way that they can be transported and delivered in accordance with the route plan 56, are provided in the stacking devices A, B, C.

The route plan 56 comprises route information or address information for the delivery of stacks comprising a plurality of products P with an association of stacks to defined delivery sequences or geographical positions, for example an association of stacks with products P assembled according to a specific product structure to specific routes, addresses or zones. Individual products P can be assembled and/or addressed individually for a recipient in one variant embodiment.

The tracking module 51 is configured to track the products P conveyed on the conveyor 2 in respect of their contents, i.e. primary products HP and intermediate products VP, and their positions on the conveyor 2, for example relative to the detection point DD and/or relative to one or more of the release points AA, BB, CC, UU (tracking information). In order to produce individualized products P which are provided, for example, with an individual address of a recipient and/or, in terms of content, with content which is geared individually to the recipient in question, a product P can be identified over its entire delivery time on the conveyor 2, from the collecting facility 4 up to stacking in a specific stack in one of the stacking devices A, B or C, or screening in the overflow station U, and tracked in terms of its position.

The planning module 53 is configured to associate the products P detected by the product detector 23 at the detection point DD in each case in the assignment plan Z dynamically to one of the stacking devices A, B, C, as is described in the following sections in respect of FIGS. 4, 5 and 6.

The regulation module 52 is configured to match the conveying speed of the conveyor 2 dynamically and automatically to the capacity utilization, processing capacity and availability of the stacking devices A, B, C, as is likewise described in the sections below in respect of FIGS. 4, 5 and 6. The conveying speed of the conveyor 2 is set to a defined maximum speed at the start of operation.

In step S1, the product detector 23 detects a product P* conveyed past the detection point DD on the conveyor 2. The corresponding detection signal is passed via the communications link 6 to the control device 5, where the detection of the product P* activates the tracking module 51 for tracking and associating the product P* to the superordinate route plan 56, and the planning module 53 for associating the product P* to one of the stacking devices A, B, C.

In FIG. 3, the reference symbol F denotes the occupation of the conveyor 2 with products P; in this case each cell f marked with a cross X represents a product carrier 20 occupied with a product P. An unmarked cell e represents an empty product carrier 20, to which no product P has been supplied from the collecting facility 4, for example in section dA, or from which the product P has already been released, for example in sections dB and dC or in the overflow region dU of the conveyor 2 following the release point CC. In FIG. 3, a large number of further product carriers 20 is indicated by the points " . . . ", with it not being possible for practical reasons to illustrate said product carriers in FIG. 3; for example the section dA has more than a hundred product carriers 20.

In the schematic illustration of the assignment plan Z in FIG. 3, the reference symbols ZA', ZB' and ZC' each denote the assignment of the products P arranged in accordance with the product occupation F on the conveyor 2 to the stacking devices A, B and C, respectively. In this case, each cell marked with a cross X in a product assignment ZA', ZB', ZC' represents an association of the product P in question indicated in the product occupation F of the conveyor 2 to the stacking device A, B, C in question. For example, the cell zi marked by a cross X in the product assignment ZB' represents an association of the product P in the product carrier 20, which is defined in the product occupation F of the conveyor 2 by the marked cell ei, to the stacking device B.

The reference symbols ZA, ZB and ZC in FIG. 3 denote the occupation of the stacking devices A, B and C with associated products B corresponding to the assignment plan Z. In this case, the reference symbols iA, iB and iC in each case denote the present internal occupation of the stacking device A, B, C in question with products P which have been supplied to the stacking device A, B, C in question by release of the release device 2A, 2B, 2C in question, and are assembled there to form a stack. The ability of a stacking device A, B, C to be occupied is dependent not only on its physical capacity and design, but also on the size and structure of the stack to be produced, i.e. on the number of layers in a stack and on the number and thickness of the products in a layer, as is illustrated below using the example of FIG. 4.

Figure 4:
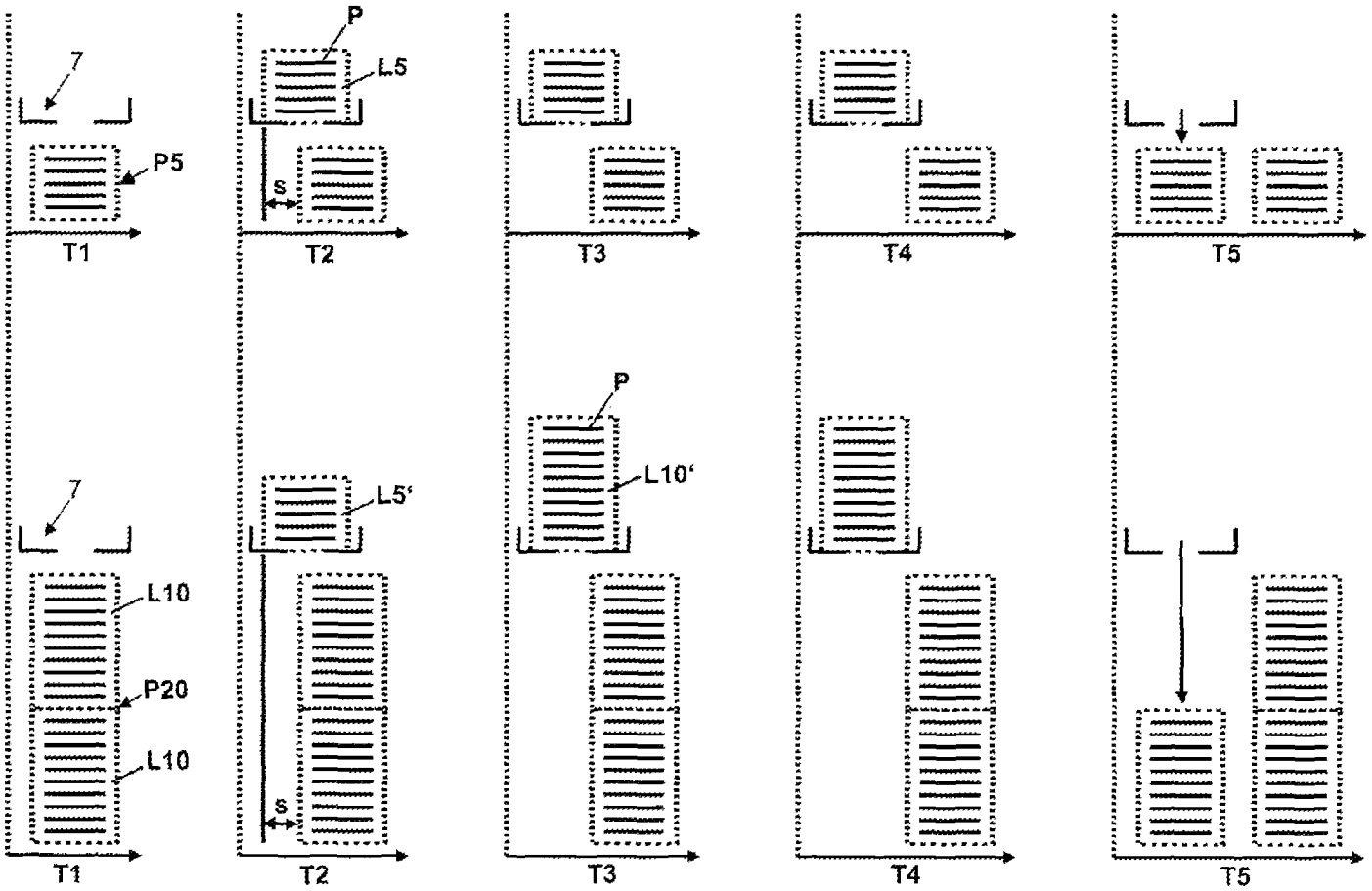
FIG. 4 shows an example of a temporal comparison of the production of stacks of different sizes in a stacking device with an intermediate stacker.

FIG. 4 shows a temporal comparison of the formation of stacks P5, P20 of different sizes in a stacking device A, B, C with an intermediate stacker 7. The upper part of FIG. 4 illustrates various points in time T1, T2, T3, T4, T5 in the formation of stacks P5 with in each case one layer L5 comprising five products P. The lower part of FIG. 4 illustrates various points in time T1, T2, T3, T4, T5 in the formation of stacks P20 with in each case two layers L10, L10' comprising ten products P.

At point in time T1, a stack P5, P20 with five or twenty products P, respectively, is completely formed in the stacking device A, B, C.

At point in time T2, for example 0.5 second after point in time T1, a layer L5 with five products P was formed on the intermediate stacker 7, while the stack P5 or P20 formed has been conveyed out of the stacking device A, B, C through a distance s.

At point in time T3, for example 1.0 second after the point in time T1, the intermediate stacker, and therefore the stacking device A, B, C in question, is prevented from receiving further products P in the upper example in FIG. 4 because the stack which has not been completely conveyed away prevents the layer L5 from being deposited. In the lower example in FIG. 4, on the other hand, a layer L10' with ten products P could be formed at the same point in time on the intermediate stacker 7, while the stack P5 or P20 was conveyed out of the stacking device A, B, C through a further distance s, with it being possible for the speed to be variable.

At point in time T4, for example 1.5 seconds after point in time T1, the stack P5 or P20 was conveyed out of the stacking device A, B, C through the further distance s both in the upper example and in the lower example in FIG. 4, without any possibility of further products P being received on the intermediate stacker 7, and therefore in the stacking device A, B, C in question.

At point in time T5, for example 2.0 seconds after point in time T1, the stack P5 or P20 was conveyed completely out of the stacking device A, B, C both in the upper example and in the lower example in FIG. 4, with the result that the layer L5 with five products or the layer L10' with ten products P could be deposited from the intermediate stacker 7 in the stacking device A, B, C so as to form the next stack P5 or P20.

As is illustrated in the example in FIG. 4, the occupation capacity of the stacking devices A, B, C is dependent on the size and number of layers L5, L10 of the stacks P5, P20 and can also vary temporally.

In FIG. 3, in the occupation ZA, ZB, ZC of the stacking devices A, B, C, cells are marked with a circle O in order to represent schematically products P or product positions according to the product occupation F on the conveyor 2 which are not processable by the stacking device A, B, C in question at a specific conveying speed of the conveyor 2, for example because the stacking device A, B, C is prevented from conveying a finished stack P5, P20 away, as described above, because products P are supplied more quickly at the present conveying speed than they can be received and processed by the stacking device A, B, C because a product P in question on the conveyor 2 cannot be assigned to the stacking device A, B, C owing to a superordinate route plan 56 or because the stacking device A, B, C has a technical problem and is not available, at least temporarily.

Figure 5:
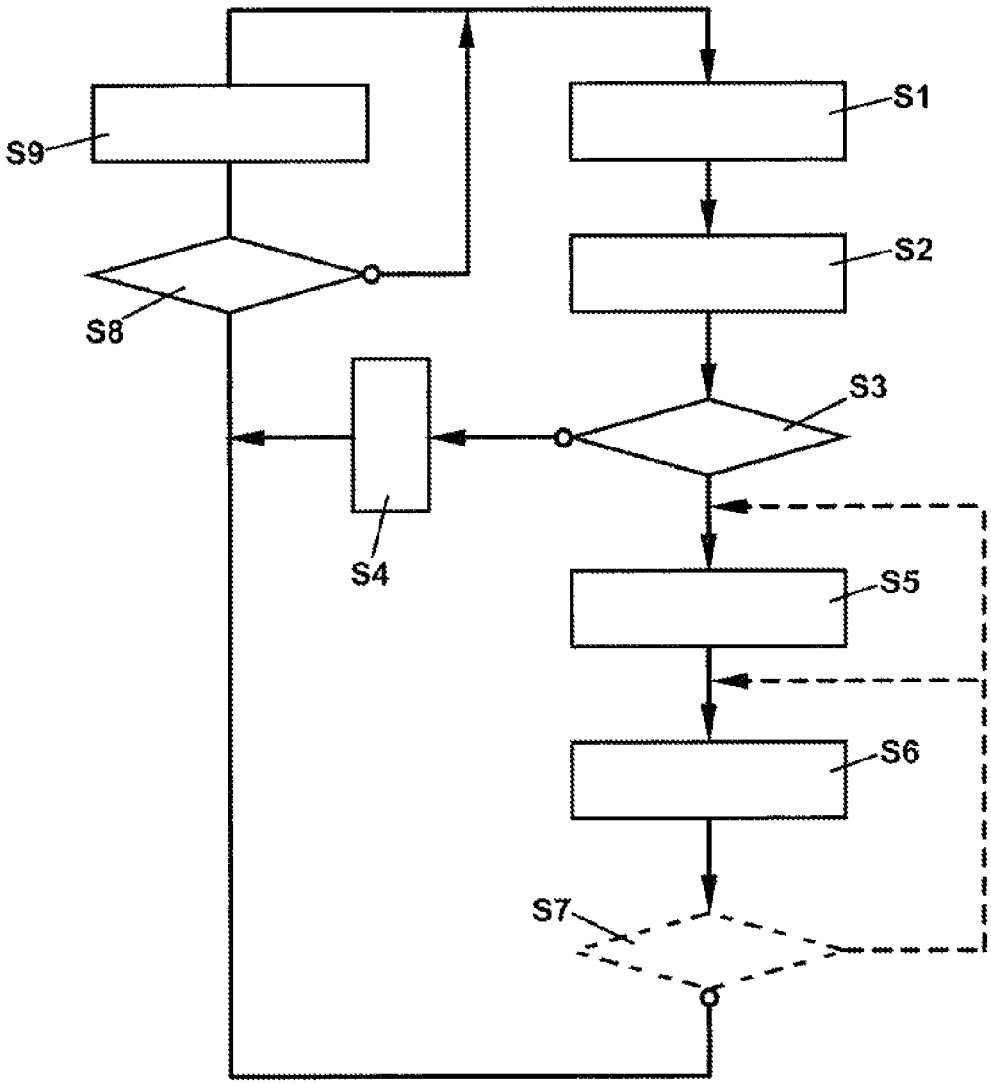
FIG. 5 shows a flow chart illustrating a first example of a possible sequence of steps for the speed regulation of the conveyor.
Figure 6:
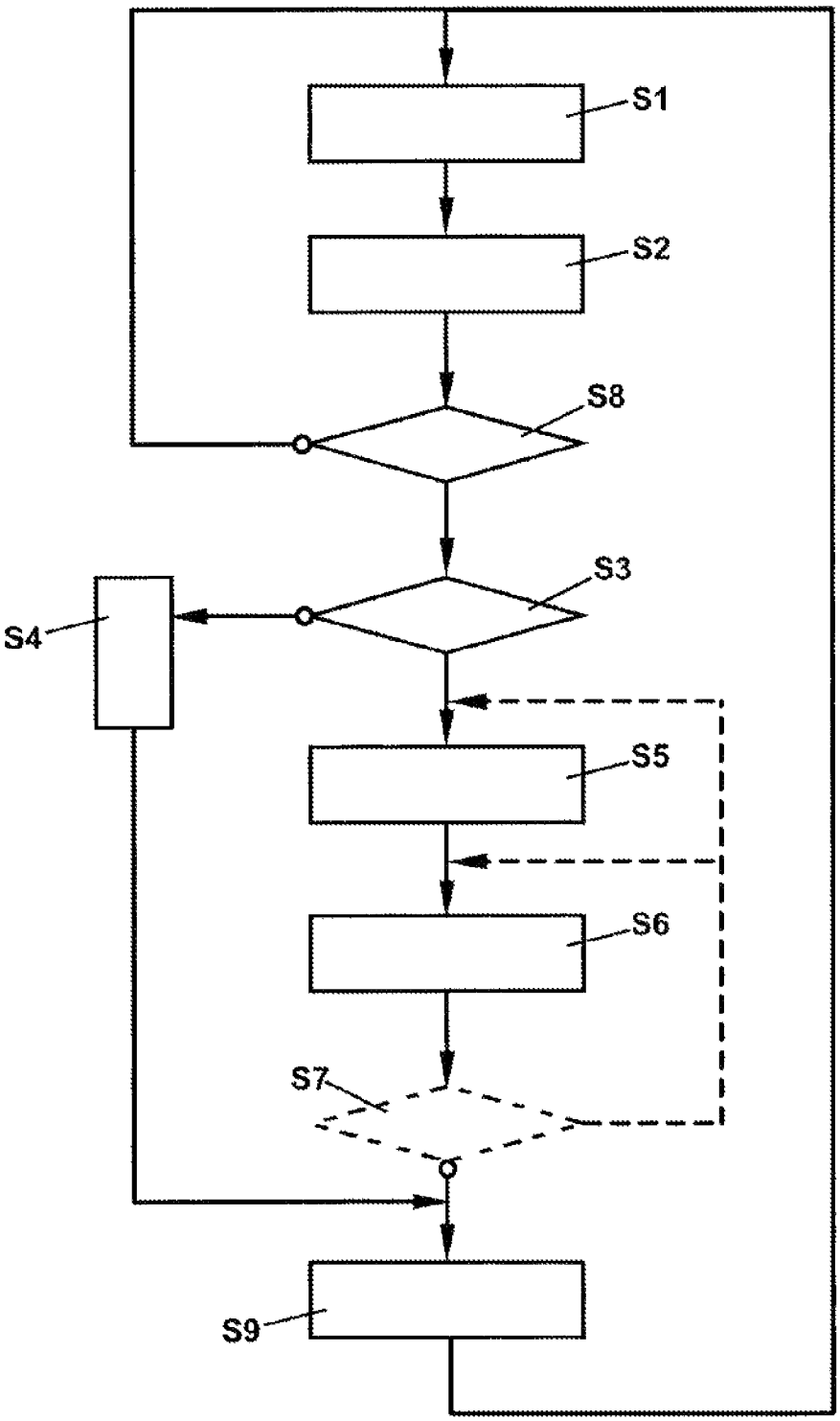
FIG. 6 shows a flow chart illustrating a second example of a possible sequence of steps for the speed regulation of the conveyor.

As shown in FIGS. 5 and 6, in step S2, the product association of the product P* detected in step S1 is performed by the planning module 53. In this case, the planning module 53 attempts, on the basis of the assignment plan Z with the already existing assignment of product P to stacking devices A, B, C and possibly on the basis of a superordinate route plan 56, to associate the detected product P* to one of the stacking devices A, B, C for processing. First, the planning module 53 determines whether, on the basis of a route plan 56, an association of the detected product P* to a specific stacking device A, B, C is predetermined or whether the detected product P* can optionally be assigned to one of the stacking devices A, B, C. Then, the planning module 53 checks whether the detected product P* is processable by the specific stacking device A, B, C and therefore assignable thereto, or by means of which of the freely selectable stacking devices A, B, C the detected product P* is processable and can thus be assigned. The planning module 53 checks in particular whether the detected product P* with its relative position or distance on the conveyor 2 with respect to the stacking device A, B, C in question at the present conveying speed of the conveyor 2 and given the existing occupation ZA, ZB, ZC of the stacking device A, B, C in question, including planned product assignment ZA', ZB', ZC' and internal occupation iA, iB, iC, and given a specific stack size, stack structure, processing speed and/or design of the stacking device A, B, C in question, is processable by the stacking device A, B, C in question and can therefore be assigned to the stacking device A, B, C in question. When the detected product P* is not processable by a routinely determined or freely selectable stacking device A, B, C, it is associated to the overflow region dU of the conveyor 2, i.e. the detected product P* is envisaged, in accordance with the configuration in FIG. 1, for release and transfer to the overflow station U or, in accordance with the configuration in FIG. 2, for being passed onto the conveyor 2, past the stacking devices A, B, C back to the detection point DD, for renewed detection by the product detector 23.

In step S3, the planning module 53 checks whether the detected product P* could be assigned for processing to a stacking device A, B, C or whether it needed to be associated to the overflow region dU. In the case of an assignment for processing to a stacking device A, B, C, the regulation module 52 moves onto step S4, otherwise to step S5.

In step S5, the regulation module 52, on the basis of the detected product P* which could not be associated as processable to a stacking device A, B, C, initiates a reduction in the conveying speed $v_F$ of the conveyor 2 by virtue of the fact that it fixes a setpoint speed 55 $v_{set}$ which corresponds to the conveying speed $v_F$ reduced by a defined difference value Δv for example $v_{set}=v_F-\Delta v$=36 000 products/h−1000 products/h=35 000 products/h.

In step S6, the planning module 53 performs, on the basis of the setpoint speed 55 $v_{set}$, a reassignment of the products P which have not yet been released and are located on the conveyor 2 in sections dA, dB or dC. In this case, depending on the variant embodiment or selected operating mode, various reduction points in time are assumed at which the actual present conveying speed $v_F$ is set to the setpoint speed 55 $v_{set}$.

In a first variant, the reduction point in time is fixed to a fixed time period, i.e. a gradual reduction in speed takes place possibly at periodic points in time, for example in each case after one or after ten seconds.

In a second variant, the reduction point in time is fixed to a point in time at which a fixedly determined point on a section between the detection point DD and the release points AA, BB, CC is reached, for example the point in time at which the most recently detected product P* reaches a predetermined distance from one of the release points AA, BB, CC.

In a further variant, the reduction point in time is fixed at a point in time which is as late as possible (for example at one of the periodic points in time) in such a way that a processable assignment to stacking device A, B, C results for all products which have not yet been released. This latest possible point in time is determined iteratively, for example, with various points in time being checked at which a specific point on a section between the detection point DD and the release points AA, BB, CC is reached (for example by the most recently detected product P*), for example in accordance with fixed distances (for example at 90%, 80%, 70% etc.) or stepwise as in the case of a binary search algorithm.

In the case of the reassignment of as yet unreleased product P, a varying conveying speed $v_F$ is therefore assumed which corresponds to the present conveying speed $v_F$ up to the reduction point in time and, from the reduction point in time on, is reduced to the setpoint speed 55 $v_{set}$. The reassignment preferably takes place beginning with the "oldest" as yet unreleased product P, which is located at the next to last release point CC, then the "younger" products P up to the "youngest" product which is the most recently detected product P*, in accordance with the criteria which were already described in connection with step S2.

In step S7, which is optional, the planning module 53 checks whether all of the as yet unreleased products P could be assigned as processable to one of the stacking devices, A, B, C at the setpoint speed 55 $v_{set}$. If this is not the case, in step S5 a further speed reduction is optionally determined and/or in step S6 an earlier point in time for the speed reduction is checked iteratively.

In step S4, the planning module 53 checks whether a product P which has been the cause of a reduction in the conveying speed $v_F$ or setpoint speed 55 $v_{set}$ of the conveyor 2 has reached a defined position, for example the release point AA, BB, CC of the associated stacking device A, B, C and increases the setpoint speed 55 $v_{set}$ of the conveyor 2 by the defined difference value Δv.

In step S8, the regulation module 52 checks whether the point in time for a gradual matching of the conveying speed $v_F$ has been reached, i.e. whether the present time value corresponds to the point in time fixed for a speed matching or a specific product P has reached a correspondingly defined position on the conveyor 2. If this is the case, the regulation module 52, in step S9, sets the conveying speed of the conveyor 2 to the setpoint speed 55 $v_{set}$, i.e. the present conveying speed is reduced or increased by a defined difference value Δv.

In FIGS. 5 and 6, corresponding reference symbols each denote mutually corresponding steps, but the step sequence in the variant embodiments in accordance with FIGS. 5 and 6 differ. In contrast to the variant embodiment shown in FIG. 5, in the variant embodiment shown in FIG. 6 matching of the setpoint speed 55 $v_{set}$ and, on the basis of this, reassignment of the as yet unreleased products P are only performed when, corresponding to the check in step S8, the point in time for gradual matching of the conveying speed $v_F$ has been reached. Apart from an implementation of the optional step S7, in the variant embodiment shown in FIG. 6 matching of the setpoint speed $v_{set}$ 55 always also effects direct matching of the conveying speed $v_F$.

Finally, it should be mentioned that although computer program code has been associated to specific functional modules in the description and that the implementation of steps in specific sequences has been represented, it will be clear to a person skilled in the art that the computer program code can be structured differently and the sequence of at least certain steps can be changed without in the process deviating from the protected subject matter.

LIST OF REFERENCE SYMBOLS

1 Printed product processing facility
2 Conveyor
4 Collecting facility
5 Computerized control device (computer)
6 Communications link
7 Intermediate stacker
2A, 2B, 2C, 2U Release device
20 Product carrier
21, 22 Product processing device
23 Product detector
31, 32 Separating device
51 Tracking module
52 Regulation module
53 Planning module
54 Control module
55 Setpoint speed (setpoint value of speed)
56 Route plan
A, B, C Stacking device
AA, BB, CC, UU Release point
d Distance between two product carriers
dA, dB, dC Section of conveyor
DD Detection point
dU Overflow region
e Unmarked cell with empty product carrier
F Product occupation of conveyor
f Marked cell with occupied product carrier
HP Primary product
iA, iB, iC Internal occupation of a stacking device
L5, L5' Layer with five products
L10, L10' Layer with ten products
P, P* Product
P5 Stack with a layer of five products
P20 Stack with two layers of ten products each
s Distance at delivery in a stacking device
S1 Product detection
S2 Product association
S3, S7 Checking whether processable association is possible
S4 Increasing the conveying speed
S5 Determining a reduced setpoint speed
S6 Reassociation of unreleased
S8 products
S9 Checking whether point in time for speed matching has been reached
T1, T2, T3, T4, T5 Setting the conveying speed to the setpoint speed
U Points in time
VP Overflow station
Z Intermediate product(s)
ZA, ZB, ZC Assignment plan
ZA', ZB', ZC' Occupation of a stacking device Product assignment to a stacking device

The invention claimed is:

1. A computerized control device for regulating the speed of a conveyor for delivering printed products to stacking devices which form stacks from products supplied, comprising:

a planning module, which is configured to run an assignment plan for the stacking devices with products which have been detected at a detection point upstream of the stacking devices on the conveyor and are processable by, in each case, one associated stacking device at a defined setpoint speed of the conveyor; and a regulation module, which is configured to reduce the setpoint speed of the conveyor when it is not possible to determine, within the assignment plan, a stacking device for at least one product which can process the at least one product at the unreduced setpoint speed of the conveyor.

2. The device of claim 1, further comprising a tracking module, which is configured to determine in each case one present position on the conveyor or in the associated stacking device for the products included in the assignment plan, and in that the regulation module is configured to increase the setpoint speed of the conveyor when a product which has been the cause of a reduction in the setpoint speed of the conveyor has reached a defined position.

3. The device claim 1 wherein the planning module is configured to determine, for a product, on the basis of the present position of the product in question, on the basis of processing speeds of the stacking devices, on the basis of the setpoint speed of the conveyor and on the basis of the association of products to in each case one of the stacking devices according to the assignment plan, whether and by means of which of the stacking devices the product in question is processable at the defined setpoint speed of the conveyor.

4. The device of claim 1 wherein the regulation module is configured to set the present conveying speed of the conveyor to the setpoint speed in each case at a defined point in time, and in that the planning module is configured to associate a product to one of the stacking devices in the assignment plan when the product in question is proces sable by the stacking device in question at a conveying speed set to the reduced setpoint speed from the defined point in time on.

5. The device of claim 4, wherein the planning module is configured to set the point in time for setting the present conveying speed of the conveyor to the reduced setpoint speed to be as late as possible such that the product in question is still processable by the associated stacking device in question.

6. The device of claim 1, wherein the regulation module is configured to set the present conveying speed of the conveyor to the setpoint speed at periodic points in time.

7. The device of claim 1, wherein the planning module is configured to associate, in the event of a reduction in the setpoint speed of the conveyor, the products which are included in the assignment plan and are still located on the conveyor in each case afresh to one of the stacking devices by means of which the product in question is processable at the reduced setpoint speed of the conveyor.

8. A computer-implemented method for regulating the speed of a conveyor for delivering printed products to stacking devices which form stacks from supplied products, the method comprising:

running an assignment plan in the computer for the stacking devices, with products which have been detected at a detection point upstream of the stacking devices on the conveyor and are processable by in each case one associated stacking device at a defined setpoint speed of the conveyor; and reducing the setpoint speed of the conveyor by the computer when it is not possible to determine, in the assignment plan for at least one product, a stacking device which can process the at least one product at the unreduced setpoint speed of the conveyor.

9. The method of claim 8, wherein for the products included in the assignment plan, in each case one present position on the conveyor or in the associated stacking device is determined in the computer, and in that the computer increases the setpoint speed of the conveyor when a product which has been the cause of a reduction in the setpoint speed of the conveyor has reached a defined position.

10. The method of claim 8, wherein the computer determines, for a product, on the basis of the present position of the product in question, on the basis of processing speeds of the stacking devices, on the basis of the setpoint speed of the conveyor and on the basis of the association of products to in each case one of the stacking devices according to the assignment plan, whether and by means of which of the stacking devices the product in question is processable at the defined setpoint speed of the conveyor.

11. The method of claim 8, wherein the computer sets the present conveying speed of the conveyor to the setpoint speed in each case at a defined point in time, in that the computer associates, in the assignment plan, a product to one of the stacking devices when the product in question is processable by the stacking device in question at a conveying speed which is set to the reduced setpoint speed from the defined point in time on, and in that the computer sets the point in time for setting the present conveying speed of the conveyor to the reduced setpoint speed as late as possible such that the product in question is still processable by the associated stacking device in question.

12. The method of claim 8, wherein the computer sets the present conveying speed of the conveyor to the setpoint speed at periodic points in time.

13. The method of claim 8, wherein in the event of a reduction in the setpoint speed of the conveyor, the computer associates the products which are included in the assignment plan and are still located on the conveyor in each case afresh to one of the stacking devices, by means of which the product in question is processable at the reduced setpoint speed of the conveyor.

14. A computer program product, comprising a tangible computer-readable storage medium with a stored computer code, which is configured to control one or more processors of a computerized control device for regulating the speed of a conveyor for delivering printed products to stacking devices, the processors are configured to:

run an assignment plan for the stacking devices with products which have been detected at a detection point upstream of the stacking devices on the conveyor and are processable by in each case one associated stacking device at a defined setpoint speed of the conveyor, and reduce the setpoint speed of the conveyor when it is not possible to determine, in the assignment plan for at least one product, a stacking device which can process the at least one product at the unreduced setpoint speed of the conveyor.

15. The computer program product of claim 14, wherein the storage medium comprises a further computer code which is configured to control the one or more processors in such a way that the processors are configured to:

run an assignment plan in the computer for the stacking devices, with products which have been detected at a detection pointupstream of the stacking devices on the conveyor and are processable by in each case one associated stacking device at a defined setpoint speed of the conveyor; and reduce the setpoint speed of the conveyor by the computer when it is not possible to determine, in the assignment plan for at least one product, a stacking device which can process the at least one product at the unreduced setpoint speed of the conveyor.

* * * * *